US008215527B2

(12) United States Patent
Fathi

(10) Patent No.: US 8,215,527 B2
(45) Date of Patent: Jul. 10, 2012

(54) DISPENSER FOR LENGTH MATERIAL

(76) Inventor: Hacene Fathi, Montréal (CA)

( * ) Notice: Subject to any disclaimer, the term of this patent is extended or adjusted under 35 U.S.C. 154(b) by 442 days.

(21) Appl. No.: 12/320,755

(22) Filed: Feb. 4, 2009

(65) Prior Publication Data

US 2010/0193539 A1 Aug. 5, 2010

(51) Int. Cl.
*B65H 35/07* (2006.01)

(52) U.S. Cl. ..... 225/51; 225/52; 225/56; 156/577

(58) Field of Classification Search ..... 225/11–13, 225/51, 52, 56–66, 68, 84–87; 156/523, 156/577, 574; D19/69
See application file for complete search history.

(56) References Cited

U.S. PATENT DOCUMENTS

| | | | | | |
|---|---|---|---|---|---|
| 534,535 | A * | 2/1895 | Walter | 225/58 |
| 2,272,628 | A * | 2/1942 | Anderson | 225/60 |
| 2,524,453 | A * | 10/1950 | Locke | 225/61 |
| 2,611,432 | A * | 9/1952 | Tallman | 225/57 |
| 2,670,042 | A * | 2/1954 | Isler | 225/57 |
| 2,706,003 | A * | 4/1955 | Isler | 225/66 |
| 2,788,181 | A * | 4/1957 | Anderson | 225/65 |
| 3,085,727 | A * | 4/1963 | Waltz | 225/66 |
| 3,187,968 | A * | 6/1965 | Favre | 225/56 |
| 3,374,139 | A * | 3/1968 | Fritzinger | 156/523 |
| 3,664,597 | A * | 5/1972 | Norman et al. | 242/564 |
| 3,902,956 | A * | 9/1975 | Thompson, Jr. | 225/51 |
| 3,968,915 | A * | 7/1976 | Schleicher | 225/65 |
| 4,447,482 | A * | 5/1984 | Heinzelman et al. | 225/2 |
| 5,174,850 | A * | 12/1992 | Stefan | 156/523 |
| 5,381,942 | A | 1/1995 | Lin | |
| 5,562,262 | A * | 10/1996 | Pennell | 156/577 |
| 5,564,645 | A * | 10/1996 | Lissoni | 242/423.1 |
| 5,921,450 | A | 7/1999 | Robinson | |
| 6,065,519 | A | 5/2000 | Lee | |
| 6,152,344 | A * | 11/2000 | Jensen | 225/77 |
| 6,612,474 | B2 * | 9/2003 | Shah | 225/51 |
| 6,662,844 | B2 * | 12/2003 | Huang | 225/56 |
| 6,712,113 | B1 | 3/2004 | Peggion | |
| 6,848,490 | B2 * | 2/2005 | Ho | 225/56 |
| 7,121,312 | B2 * | 10/2006 | Yu | 225/66 |
| 7,175,062 | B2 * | 2/2007 | Shah | 225/51 |
| 7,334,620 | B2 | 2/2008 | Imazeki | |
| 7,357,285 | B2 | 4/2008 | Namekawa et al. | |
| 7,380,693 | B2 | 6/2008 | Huang | |
| 7,735,770 | B2 * | 6/2010 | Conner | 242/564.1 |
| 2007/0194165 | A1 | 8/2007 | Lee | |
| 2007/0246153 | A1 * | 10/2007 | Schurman | 225/66 |
| 2008/0135181 | A1 | 6/2008 | Lee | |

* cited by examiner

*Primary Examiner* — Jason Daniel Prone
(74) *Attorney, Agent, or Firm* — Equinox Protection Inc.; Franz Bonsang, Patent Agency

(57) ABSTRACT

A dispenser for length material comprises a first resiliently biased locking roller and a second locking roller defining a nip therebetween for the passage of length material to be dispensed, the second roller being carried on a frame which upon appropriate movement causes the second roller to move into a locking position in relation to the first locking roller to clamp the length material to prevent unreeling or return of the free end thereto once appropriate cutting of a portion of the length material has been effected.

23 Claims, 8 Drawing Sheets

DISPENSER FOR LENGTH MATERIAL

FIELD OF THE INVENTION

The present invention relates to a dispenser for length material of the kind normally provided on reels, rolls or spools for use in a multiplicity of applications. Such length material may be in the form of adhesive tape, either single- or double-sided, narrow web material such as ribbons, which may be textile or metallic, wire, rope or indeed any length material to be dispensed in selected and varying dimensions dependent upon requirements.

BACKGROUND OF THE INVENTION

Adhesive tape dispensers are well known with diverse constructions targeted upon specific needs. However, the general need is that the free end of the reeled length material is separated form the main body of the stored tape, usually held on a roll or reel, such that a length of the tape may be suitably applied for the desired purpose and then cut. The objective is to ensure that the free end then remaining as part of the stored tape does not fall back upon the roll, thus requiring fresh and often difficult separation therefrom before further tape may be dispensed effectively without difficulty.

Various attempts have been made to alleviate this problem with proposals forming the subject matter of earlier patents. For example U.S. Pat. No. 5,921,450 to Robinson discloses a trapezoidally-shaped roller which contacts the tape in its partially unrolled condition and effectively brakes the tape and prevents the free end from returning to the roll once cutting of a length has occurred.

U.S. Pat. No. 5,381,942 to Lin describes an adhesive tape dispenser including a spring-loaded lever which serves to hold the tape against a roller to prevent roll back, the lever being releasable when it is desired to unwind further stored tape from the roll.

U.S. Pat. No. 7,380,693 to Huang illustrates a desktop tape dispenser comprising a multiplicity of parts including a roller over which tape unwound from the roll of stored tape is reeved, the length of cut being set and controlled by an indexing mechanism ensuring that tape roll back onto the stored tape roll does not occur.

These examples of prior art are targeted at the dispensing of adhesive tape only and may be effective in that regard, but length material may be of a textile or indeed metallic character in web form in the absence of any adhesive. The web form may be as in a ribbon or band, or in the case of metal, may be wire. Accordingly the free end successively has to be secured in some way to the reel or roll upon which it is stored awaiting further unwinding and dispensing for the purpose of cutting a desired length. Some such materials may have inherent springiness or at the other extreme may be limp in character, thus exacerbating the problem of controlling and locking the free end of the material pending further unwinding. Obviously, some springy materials may have a predisposition to move away from the reel or roll and occasion unwinding and consequent loosening of the wound material on the reel, thus causing further difficulty. With limp materials, the free end often twists causing creasing and unraveling can also result.

Accordingly, there is a need for an improved and efficacious dispenser for length material with the versatility to handle many and varied types of length material.

SUMMARY OF THE INVENTION

It is therefore a general object of the present invention to provide an improved and efficacious dispenser for length material.

An advantage of the present invention is that the dispenser isolates the free end of the length material from the stored length material.

Another advantage of the present invention is that the dispenser for length material permits the temporary locking of the free end in an isolated mode away from the stored material until further feeding and cutting of the length material is required.

As another advantage of the present invention, the dispenser for length material permits the dispensing of material, including unlocking, pulling, blocking (and preferably locking) and cutting, with only one hand of the user (thus leaving the other hand free), especially when the dispenser is mounted within a casing or housing securable onto the user (using wristband or the like) or on an adjacent working surface. Preferably, the dispenser and housing can be made to be ludic and/or aesthetically attractive, especially for kids.

Still another advantage of the present invention is that the dispenser for length material allows a pressure applied onto the tape to be uniformly distributed along the width thereof via the main locking rollers, to ease dispensing of the tape material and prevent, or at least significantly reduce, possible tearing or breaking of the same.

A further advantage of the present invention is that the dispenser for length material prevents inadvertent winding back of the free end of the length material onto the roll or the like by blockage.

Yet another advantage of the present invention is that the dispenser for length material can be used in different ways, such as a standalone dispenser mounted on a roll of length material, or inside different types of casing.

The stored material may be wound on a reel or roll, such for example as in the case of adhesive tape of necessity, or may merely be freely coiled, or it may just be stored in the absence of any particular form or former.

In accordance with an object of the present invention, there is provided a dispenser for length material comprising:

- a resiliently biased rotatable first locking member defining a first axis;
- a second locking member defining a second axis substantially parallel to said first axis and spaced therefrom;
- a nip defined between the first and second locking members for receiving therethrough in use an end portion of the length material;
- an underlying dispensing surface for supporting in use said end portion, the first locking member being biased towards said surface; and
- a movable frame circumjacent the first locking member for selective contact therewith, the frame carrying said second locking member and being adapted in use to effect relative movement between the first and second locking members selectively between a locked configuration in which in use the length material is clamped in the nip by the resiliently biased first locking member acting against the second locking member and an unlocked configuration in which the length material is free to move through the nip.

The first and second locking members may be simple bars of or coated with a low friction material but which in a locking mode relative to one another afford a clamping action on the length material within the nip.

Preferably in one embodiment of the invention the first and second locking members are freely rotatable rollers with the first locking roller being of relatively larger diameter than the second locking roller, and conveniently the rollers are of hollow cylindrical form.

The first locking roller advantageously floats within the frame, which accommodates the resilient bias for the roller. In particular, there is provided a cross bar on which is rotatably mounted a contact roller resiliently biased into rolling contact with the inner cylindrical surface of the hollow first locking roller. A second, mounting, roller may be provided internally of the first locking roller and mounted on an axle forming part of the frame, the axes of both the contact roller and the mounting roller being substantially parallel to the first axis and the two rollers being selectively in contact with one another.

A spring-loaded mount is provided and is adapted to locate and hold the dispenser onto a tubed roll of stored length material, the mount having at least one side piece for locating adjacent an end of the roll and a central member for engaging the inner surface of the tubed roll. The mount also has an arm carrying the cross bar on which the contact roller is mounted.

The frame may have a further and indeed third locking member in the form of an abutment, which upon appropriate movement of the frame towards and into the locking position is capable of pushing the first locking member further into a clamping action in relation to the second locking member with the resilient bias assisting in the clamping function.

The underlying dispensing surface may be constituted by a part of the unreeled length material or may be formed on a separate element being part of the dispenser. The separate element may be another freely rotating roller intermediate the stored length material and the first locking roller or may be a surface or platform, preferably convex, of low, or coated with a low, friction material such as Nylon™ or the like. Alternatively, the platform surface could be a belt member rollably mounted around corresponding mounting shafts.

The dispenser may advantageously be provided with a guide, typically with a free roller and/or a platform, for supporting the free end of the material during the unreeling and subsequent cutting of a piece of the length material. The guide may be attached to or form an integral part of the frame in such manner as to distance the free end of the length material from the underlying dispensing surface in the locked and unlocked positions of the first and second rollers.

A cutting member may be associated with the dispenser and may for example be carried by the spring-loaded mount.

The dispenser may be housed within a casing and the cutting member may be formed on the casing. The casing may be provided with a movable closure selectively closing an opening mouth thereof to allow the free end to extend there through, the closure connecting to the dispenser to selectively unlock the dispenser, upon opening thereof, from the locked configuration to the unlocked configuration. The casing may be shaped to accommodate a roll of the length material, and if necessary the casing may be provided internally thereof with spring-loaded guides to ensure that the length material remains in contact with the relevant elements of the dispenser as the length material is unwound from the roll, which accordingly reduces in diametral extent.

In one embodiment, a resiliently loaded roller is provided in the casing and is biased to effect locking of the dispenser following release of pressure on the resiliently loaded roller.

In some embodiments of the present invention, the first and second locking members may be in the form of contoured rollers giving a ribbed surface for contacting the length material. This type of roller may advantageously be deployed for length material in line form, for example rope, string or other relatively small diameter material, the ribbed surface on the rollers giving an effectively clamping action.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

Figure 1:
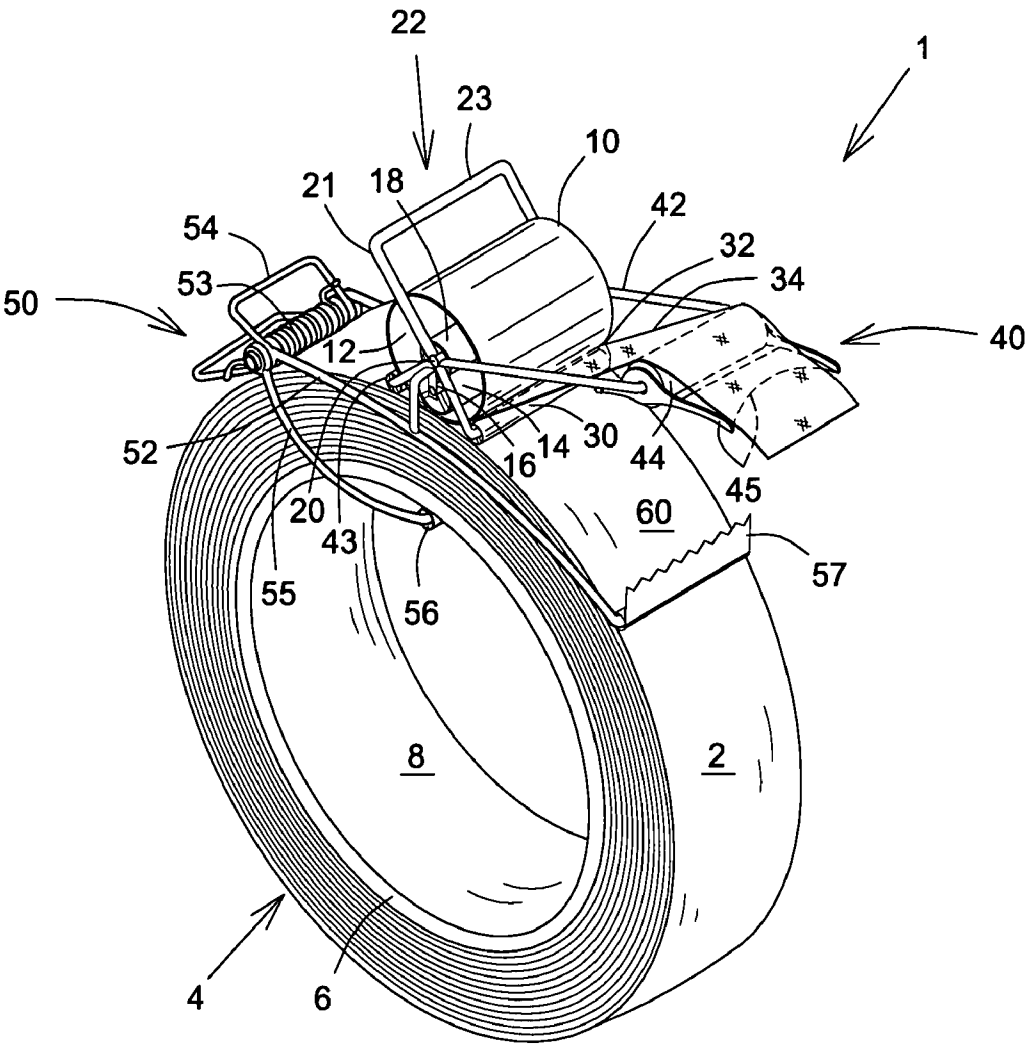
FIG. 1 is a top perspective view of a first embodiment of a dispenser for dispensing length material from a roll of the material stored on a roll.

With reference to the annexed drawings the preferred embodiment of the present invention will be herein described for indicative purpose and by no means as of limitation. The same reference numerals have been employed throughout the description to indicate like parts.

Figure 2:
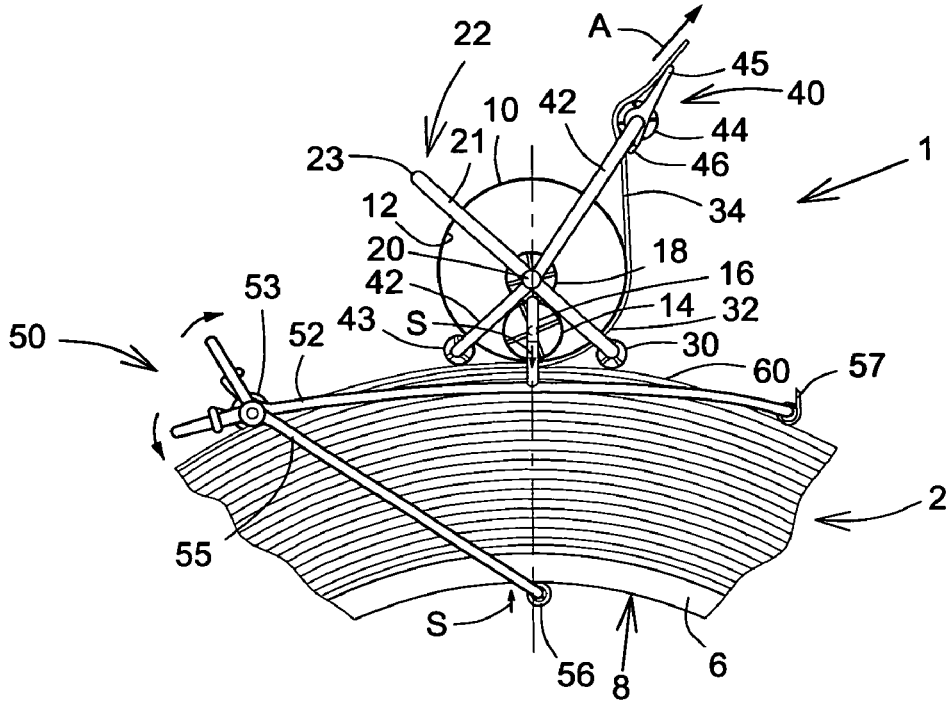
FIG. 2 is a side elevation view of a similar dispenser shown in FIG. 1, showing the dispenser in a release configuration.
Figure 3:
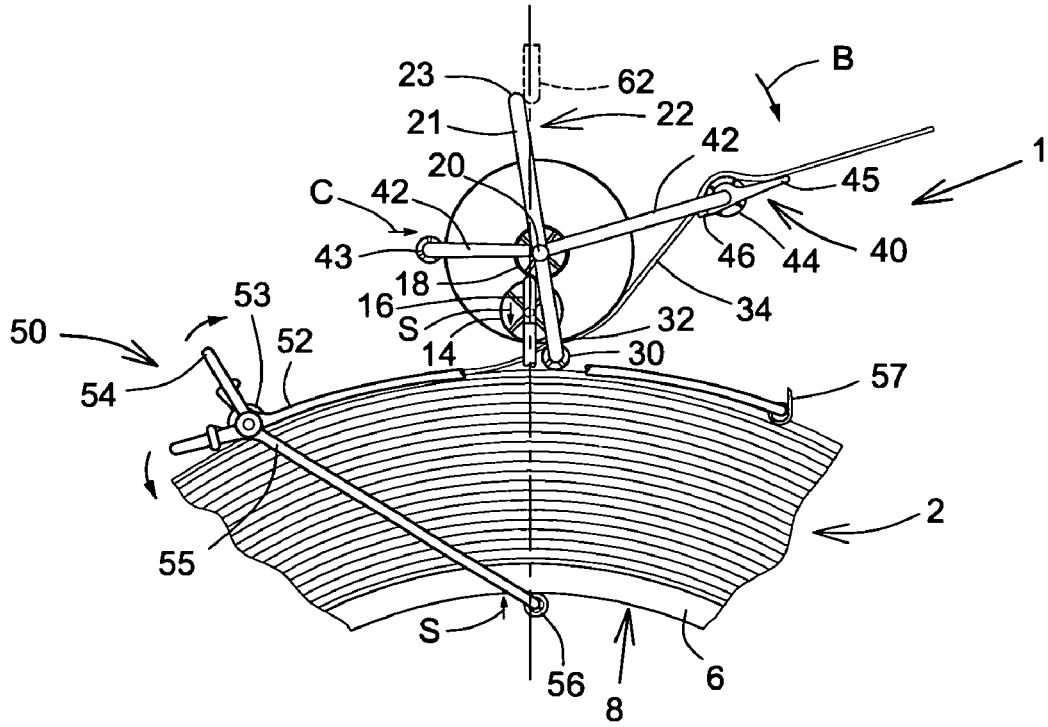
FIG. 3 is a side elevation view of the dispenser shown in FIG. 2, showing the system being rotated from the release configuration towards a blocking configuration therefor.
Figure 4:
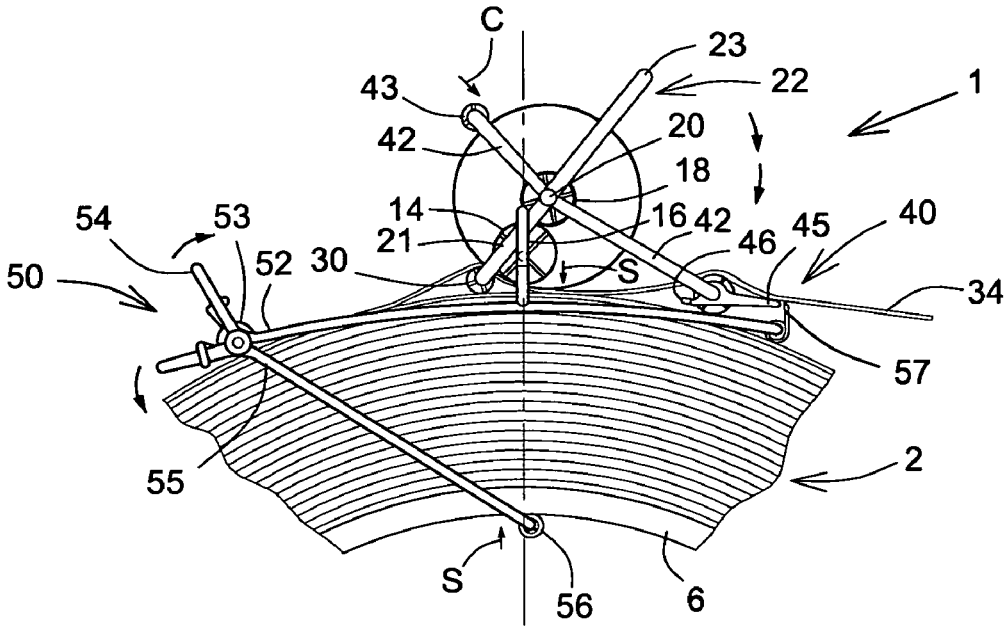
FIG. 4 is a side elevation view of the dispenser shown in FIG. 2, showing the system in a locked configuration.

Referring first to FIG. 1 and similarly to FIGS. 2 to 4, a dispenser 1 for dispensing length material, by way of illustration only adhesive tape 2 formed as a wound roll 4 on a tube 6 having an inner cylindrical surface 8. The dispenser 1 comprises in principle a first locking member in the form of a hollow cylindrical roller 10 having an inner surface 12 with which a first, resiliently biased contact roller 14 registers in rolling contact, the roller 14 being carried on a cross bar 16. A further, mounting roller 18 is provided on an axle 20 formed on an arm 21 of a frame 22 which surrounds the roller 10 with its internal rollers 14 and 18. It will be understood that the rollers 14, 18 do not need to be conterminous with the length of the roller 10, such that wheels, sprockets and the like could be used.

The frame 22, circumjacent the first locking roller 10, is typically of rigid material such as wire rod construction or the like and of generally rectangular shape as can be seen, one end 23 of which acts as a handle and the other of which carries a second locking member 30. The second locking member is a small diameter roller 30, which forms a nip 32 with the external periphery of the roller 10 at its leading side. A free end 34 of the tape 2 passes in use through the nip 32 to extend towards and over a roller guide 40 carried on a sub-frame 42 mounted at the axis of the roller 18. The sub-frame 42 in addition carries a third locking roller 43, which selectively engages the relatively trailing side of the roller 10.

The roller guide 40 typically includes a rollably mounted free roller 44 surrounded by a freely pivoting extension platform 45. The platform 45 typically has a limited motion in a clockwise direction via locking pins 46 or the like selectively abutting corresponding parts of sub-frame 42, and a concave shape allowing an easy grasping of the free end 34 adhered thereon.

A spring-loaded mount 50 is provided and embraces the roll 4 of tape by means of at least one side-piece 52, which carries the cross bar 16 on which the contact roller 14 is rotatably mounted. Preferably two side-pieces 52 are employed one either side of the roll 4. At one end of the spring-loaded mount 50 is a spring mechanism 53 releasable by use of a scissor arrangement 54, which also carries a wing 55 with a roller 56 for engagement with the surface 8 of tube 6. An extension of the sidepiece 52 is provided with a serrated cutter 57.

In operation, the dispenser 1 is applied to the roll 4 as shown with the spring-loaded mount 50 actuated accordingly by pinching the scissor arrangement thus allowing the roller 56 to be inserted within and to contact the surface 8 of the tube 6, the side pieces 52 embracing the roll 4. The roller 10 effectively floats within the frame 22, but the contact roller 14 and the roller 18 being carried respectively by the mount 50 and the frame 22 ensure that the roller 10 makes contact with the surface of the wound tape 2 (see arrows S). The surface of the tape 2 in this embodiment constitutes an underlying dispensing surface 60. The free end 34 of the tape 2 is released from the roll 4 and unwound to pass within the nip 32 between the rollers 10 and 30 and is extended to rest upon the guide 40 as shown. With the frame 22 and the rollers 10, 30 in the release or unlocked configuration shown in FIG. 2, the tape 2 may be unrolled freely to the desired length for cutting and to that end is pulled off the roll 4 in the general direction of arrow A. Although this pulling action on the free end 34 forces the first locking roller 10 to rotate counter-clockwise to frictionally force the contact roller 14 and mounting roller 18 to rotate clockwise and counter-clockwise, respectively, which causes the displacement of the frame 22 in the leading direction with the third locking roller 43 pushing on the first locking roller 10, the magnitude of the pulling force essentially prevents such frame displacement to keep the dispenser 1 in the release configuration.

When the required length has been unwound downward pressure in the direction of arrow B (FIG. 3) is applied to the tape and thus the guide 40 and in so doing the first locking roller 10 is moved towards the locking roller 30 to close the nip 32 and squeeze or clamp the free end 34 there between to prevent further unwinding with the first roller 10 off the first axis. More specifically, at that time the third roller 43 is brought into contact engagement with the first locking roller 10 (see arrow C in FIG. 3). This engagement effectively moves the roller 10 to close the nip 32 more firmly as in FIG. 3 and start rolling over the second locking roller 30, to stop the further removal of tape whilst the guide 40 with the tape 2 generally partially in abutment contact with the extension platform 45 is brought further down as indicated by the arrow B towards the cutter 57. The platform 45 presents the concave shape to allow an easy grasping of the cut free end 34 by a user and prevent the free end 34 to inadvertently fold under the free roller 44 and stick onto itself, in the case of an adhesive tape 2 (as better seen in FIGS. 1 to 3).

When it is desired to cut the desired length, the free end 34 and the guide 40 are moved further downwardly as viewed in FIG. 3 into the position as illustrated in FIG. 4 with the third roller 43 assuming the position shown, namely pressing on the roller 14 onto the roller 10 with the contact roller 14 passing over (beyond an upper unstable transition point in which the axis of the first locking roller 10 substantially passes over the normal axis direction relative to the underlying surface 60 extending perpendicularly through the axis of the second roller 30, slightly after the position shown in FIG. 3 and before the position shown in FIG. 4) the second locking roller 30 to have the spring-loaded mount 50 to maintain the first locking roller 10, preferably in contact with the underlying dispensing surface 60, in front of the second locking roller 30 with the cross bar 16 U-shaped bracket pushing down onto the arm 21, and in turn onto the tape 4 to effect a complete frictional lock to prevent further unwinding and have the dispenser 1 in the locked configuration. At this point the tape 24 may be cut by the cutter 57, which rests on the underlying dispensing surface formed by the roll of tape.

In certain applications, it may be required to maintain a block on the tape 2 in the position shown in FIG. 3 (before reaching the upper unstable transition point) for pulling and cutting, with an obviously repositioned cutter, before the dispenser 1 is automatically returned to the release unlocked position under the action of the spring-loaded mount 50, and accordingly a control element 62 as shown in dotted outline in FIG. 3 is provided.

In order to unlock and resume use of the dispenser 1 to dispense tape, the frame is merely moved counter-clockwise by handle 23 in the reverse order shown in FIGS. 4 to 2 to reinstate the freedom of movement of the tape 2 through the nip 32 between rollers 10 and 30.

Figure 4A:
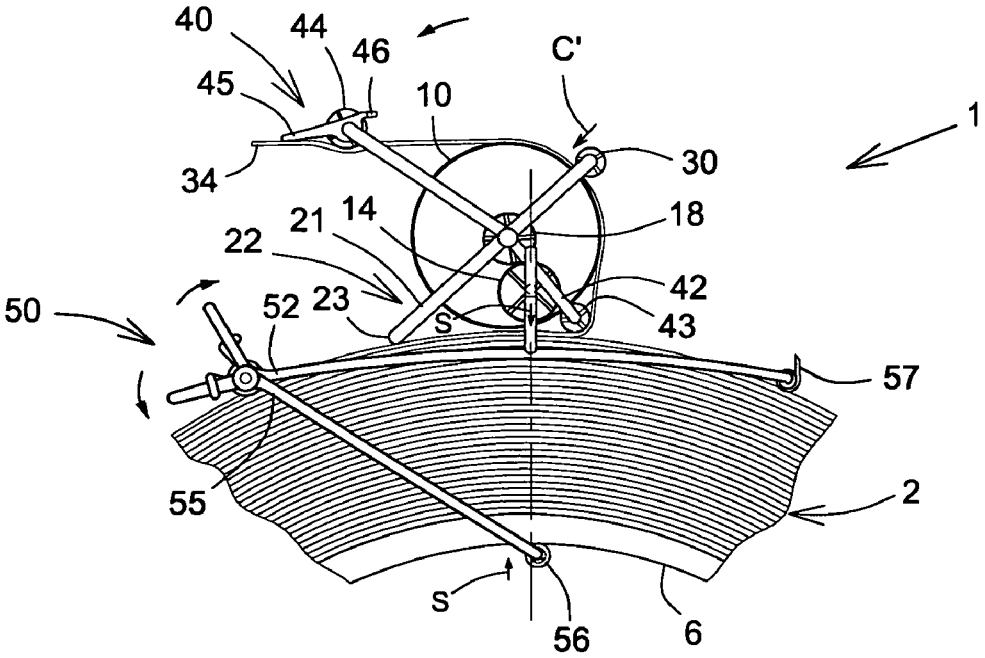
FIG. 4*a* is a side elevation view of the system shown in FIG. 2, showing the dispenser in a reverse locking configuration.

Upon any inadvertent winding back of the length material, the reverse (inward) displacement of the free end 34 forces the first locking roller 10 to rotate clockwise to frictionally force the contact roller 14 and mounting roller 18 to rotate counter-clockwise and clockwise, respectively, which causes the displacement of the frame 22 in the trailing direction with the second locking roller 30 pushing on the first locking roller 10 (which will tend to pass over the third locking roller 43), as seen by arrow C' of FIG. 4*a*, and therefore closing the nip 32 there between so as to squeeze or clamp the free end 34 and block its displacement relative to the roll 4 and the dispenser 1 now in a reverse locking configuration. Upon full rotation beyond a reverse upper unstable transition point, as schematically illustrated in FIG. 4*a* when the first locking roller 10 has passed over the third locking roller 43 with the cross bar 16 U-shaped bracket pushing down onto the sub-frame 42 (under the action of the spring-loaded mount 50—arrow S), the dispenser configuration is especially suitable for replacement of a new roll 4 and easy access to the nip 32 for passage of the free end 34 of the tape 2 there through.

Although not illustrated, the spring loaded mount could alternatively have the two (at least one) side pieces 52 carry a cross bar located on top of the first locking roller 10 (or any other configuration) to bias the latter down towards the underlying dispensing surface 60.

Figure 5:
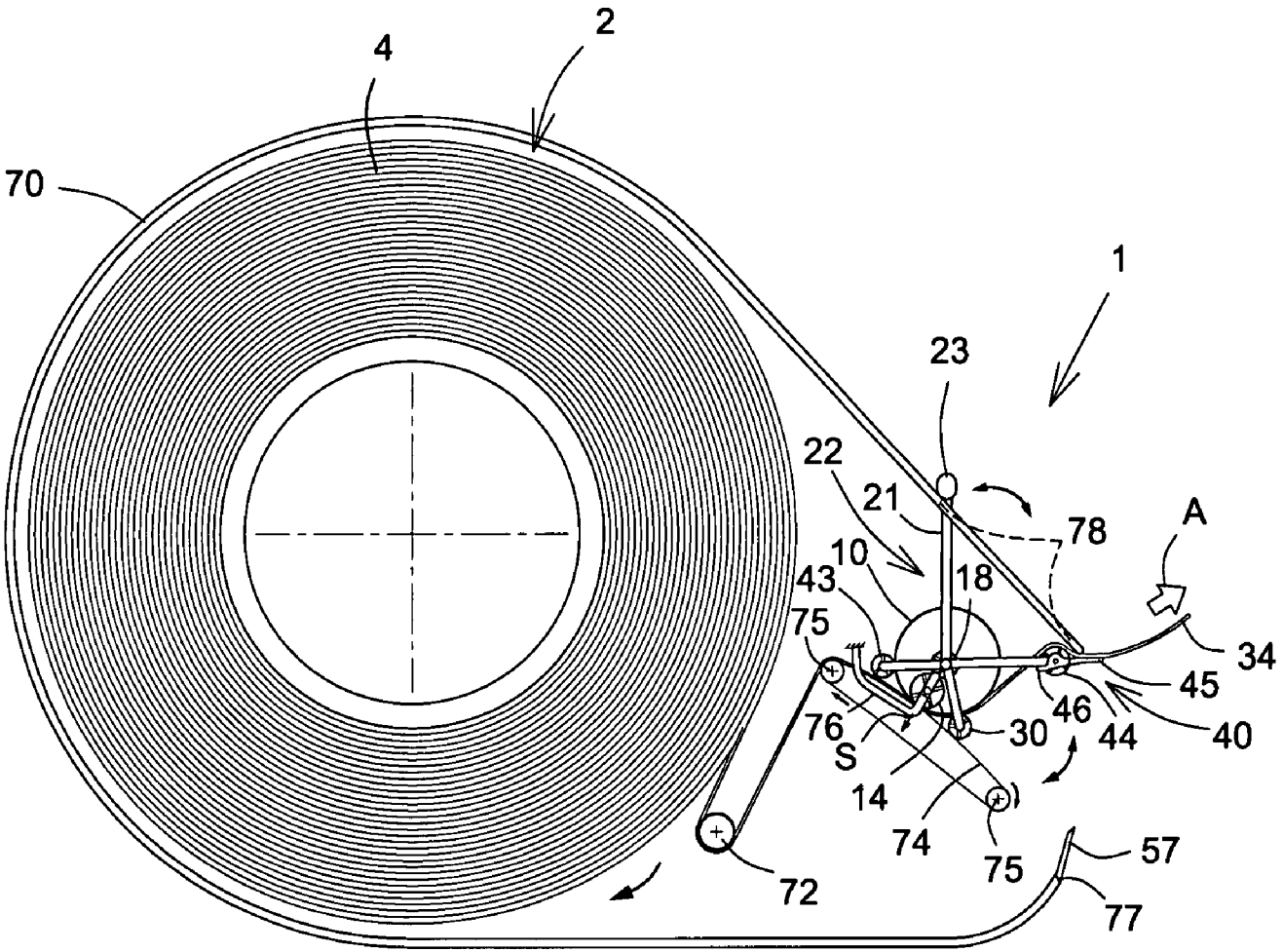
FIG. 5 is a side elevation view of a second embodiment of a dispenser for dispensing length material from a roll of the material wound on a spool.

Referring now to FIG. 5 there is shown a second embodiment of dispenser 1 and in this instance the roll 4 of tape 2 is at least partially closed within a cover 70 with an idler roller 72 provided around which the tape 2 is reeved prior to its passing to the dispenser 1 per se. The dispenser 1 comprises essentially the same components as those depicted in FIG. 1 save that the underlying dispensing surface is constituted by a, preferably slightly convex (although it could eventually be generally flat or even slightly concave), platform 74 preferably made out of a small belt or conveyor made of reasonable friction material such as rubber or the like rollably or even slidably mounted thereon about corresponding shafts 75 (at least two), or alternatively fixed and made of or coated with a low friction material such as Nylon™ or the like, and the contact roller 14 is mounted on its cross bar 16 which biasingly helds the dispenser 1 in place against the platform 74 by a biasing support bracket 76 fixed to the housing. In all other respects the dispenser 1 of the second embodiment is the same as the first embodiment and operates in the same manner. The handle 23 is disposed externally of the cover 70 with the arm 21 typically extending through a slot 78 in cover 70 and the cutter 57 is formed at a lower edge 77 of the cover.

Figure 5A:
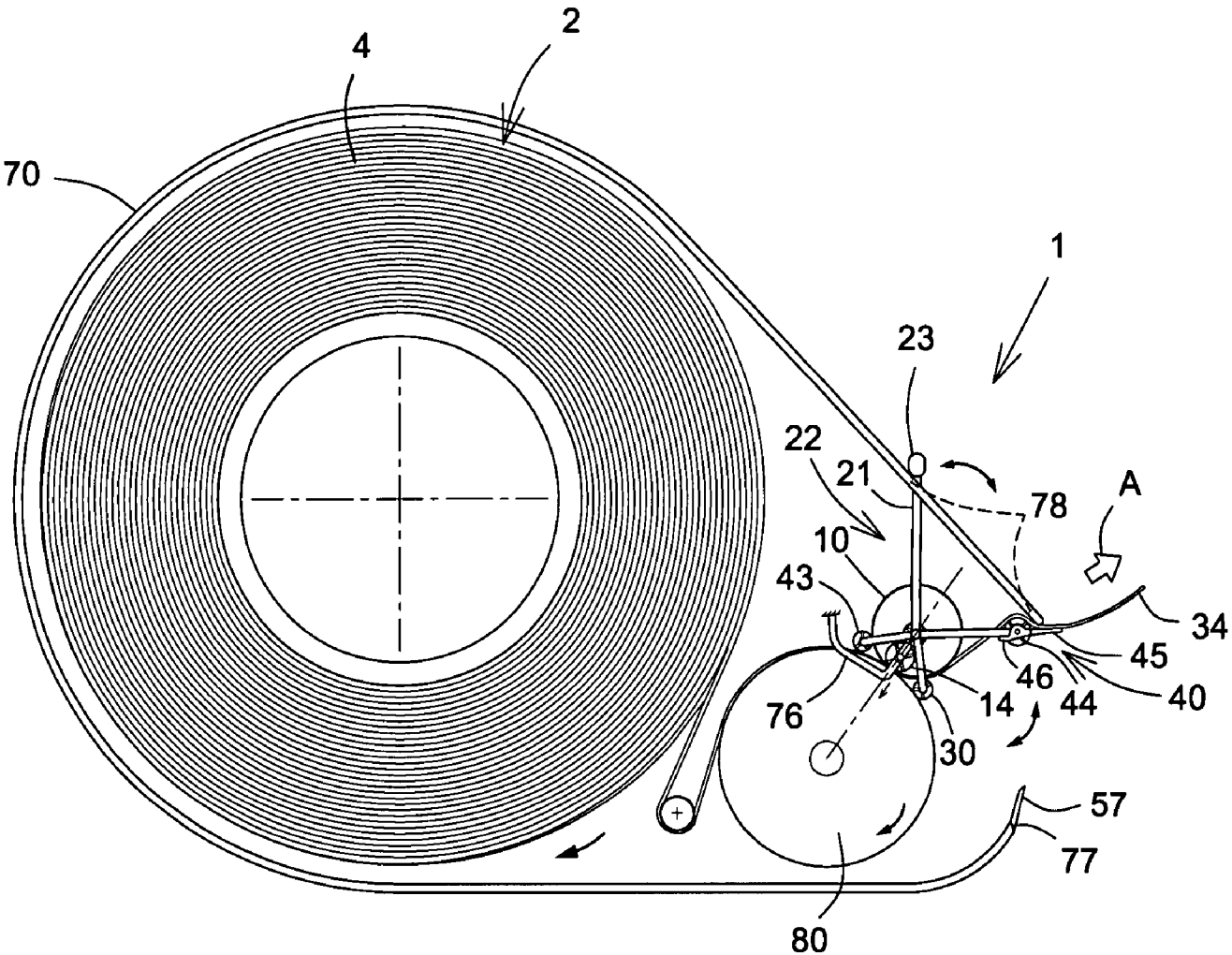
FIG. 5*a* is a side elevation view of a third embodiment of a lockable dispensing system for dispensing length material stored on a roll.

FIG. 5*a*, that is more suitable for use with an adhesive tape or the like, illustrates a variation on the design of dispenser shown in FIG. 5 in that a roller 80 has an underlying dispensing surface is substituted for the platform 74. In all other respects this embodiment operates in the same manner as the embodiment of FIG. 5.

Figure 6:
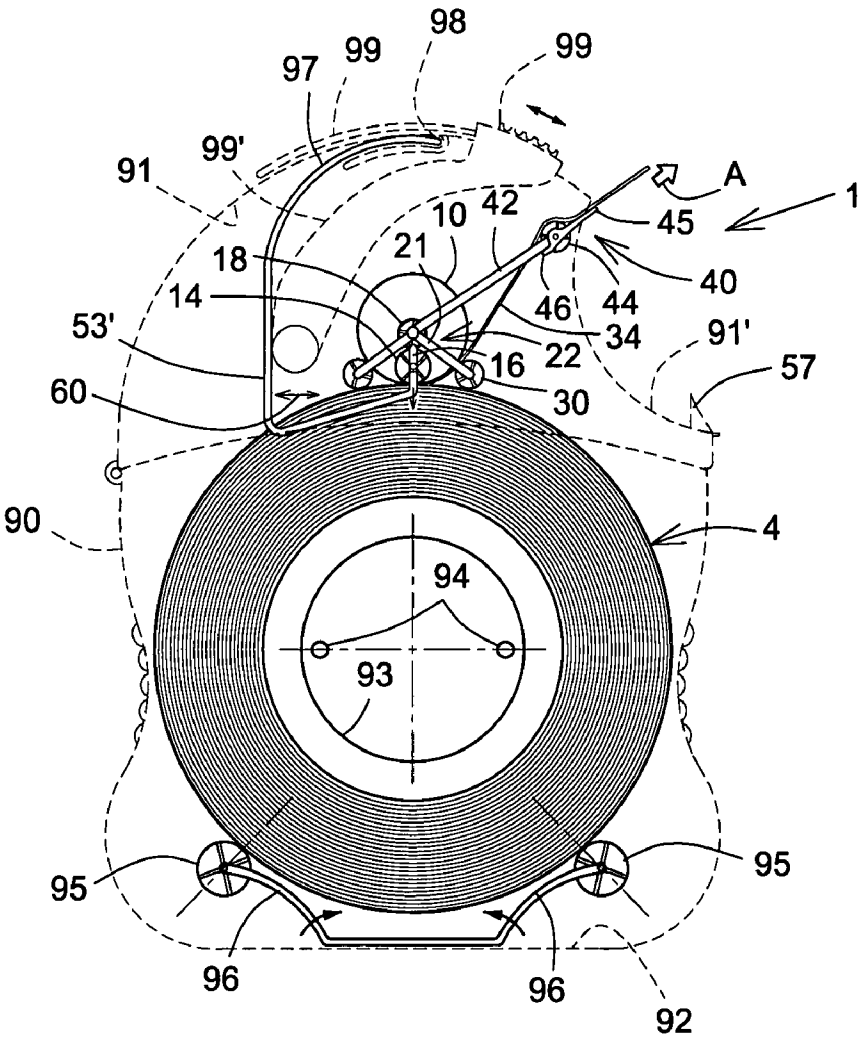
FIG. 6 is a side elevation view of a fourth embodiment of a dispenser for dispensing length material stored on a roll.

FIG. 6 depicts yet another embodiment of dispenser 1 whose characteristic features substantially match those originally described in relation to FIG. 1, but with the roll 4 contained within a housing or casing 90 shown in dotted outline. The housing 90 has a hinged lid 91 allowing access to its interior for the purpose of roll insertion and replacement and also has a cutter 57. The internal base 92 of the housing 90 is provided with pressure rollers 95 mounted on leaf springs 96, which serve to ensure that the roll 4 of tape 2 is maintained in contact with the dispenser 1 in situ. Guide pins 94 of housing 90 are generally spaced from the roll hub 93 to allow for vertical movement of the roll 4 under the action of the pressure rollers 95 and prevent excessive lateral (horizontal) movement of the roll 4. The cross bar 16 of the contact roller 14 in this embodiment is carried by the spring member 52' which is curved upwardly as at part 97 to engage in a corresponding recess 98 formed in the lid 91 such that the contact roller 14 is biased towards the roll 4. Cover 91 has a tape opening mouth 91' through which the free end 34 is pulled out. A mouth closure 99 movably mounted (pivotally and/or slidably) onto cover 91 selectively closes the mouth 91' with the dispenser 1 being either in the release configuration (as shown in FIG. 6) or in the locked configuration after the free end 34 has been pulled down and cut using the cutter 57. To restore the dispenser 1 to a dispensing mode, the closure 99 needs to be opened until an inner protrusion 99' thereof abuts the lower portion of the spring 53' to disengage the contact roller 14 and the cross bar 16 from the second locking roller 30 and the arm 21 by effectuating a pulling action on the cross bar 16 in the trailing direction for disengagement thereof. In this embodiment, the underlying dispensing surface 60 is constituted by the outer surface of the unwound tape 2. In this embodiment 1, although not shown, the cutter 57 could be alternatively located on a lower edge of the mouth closure 99.

Figure 8A:
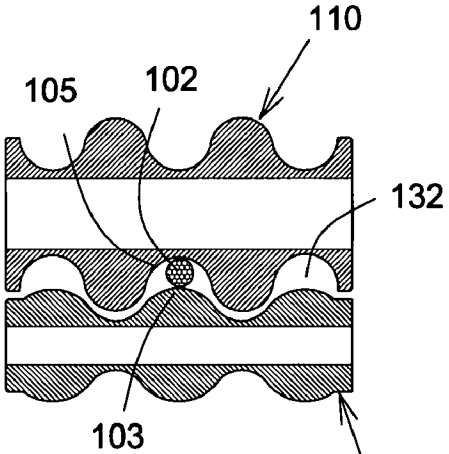
FIG. 8*a* is an enlarged partial side view taken along line 8*a*-8*a* of FIG. 7, showing the first and second locking rollers in release configuration.
Figure 8B:
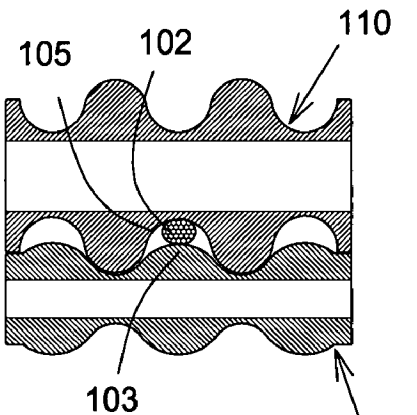
FIG. 8*b* is a view similar to FIG. 8*a* showing the first and second locking rollers in blocking and locked configurations.
Figure 7:
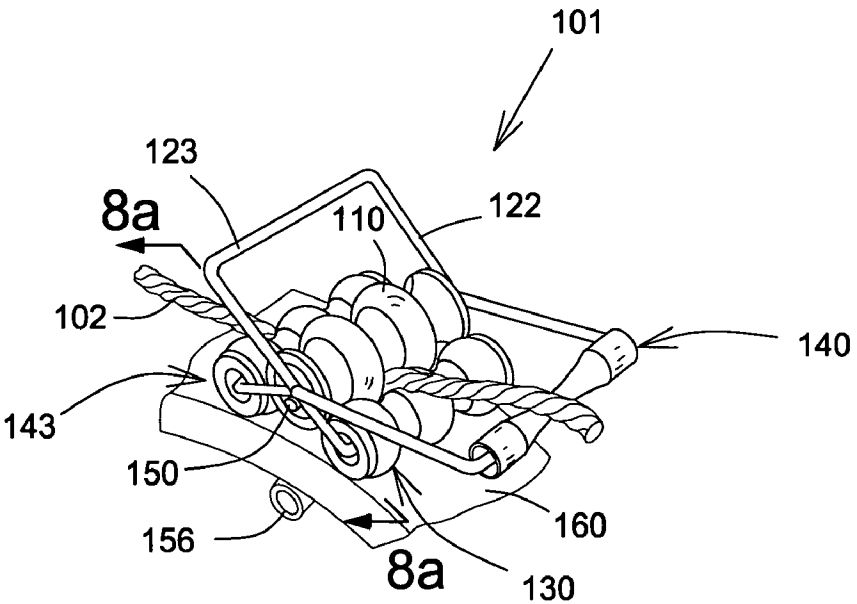
FIG. 7 is a partially broken top perspective view of a fifth embodiment of a dispenser for dispensing length material.

With reference now to FIG. 7, the dispenser 101 of this embodiment is employed for dispensing length material in the form of a line 102, for example a rope of either fibre or wire stranded. As can be seen, the freely rolling locking rollers 110 and 130 are contoured to give a substantially ribbed appearance with the line 102 passing between a trough 105 on roller 110 and a rib 103 on roller 130 (the opposite, i.e. trough on roller 130 and rib on roller 110 could also be considered). In all other respects the dispenser 101 is formed in similar fashion to the first embodiment. An underlying dispensing surface 160, on which the roller 110 generally abuts under the action of a spring mount 150, is provided and is preferably arcuate, and may be provided separately or by the surface of a drum (not shown) on which the line 102 is wound (not shown). In operation, once the requisite length of line 102 is unwound from the stored length material (not shown) the guide 140 is moved by the operative in a downwards direction from the position shown in FIG. 8*a* thus causing the second locking roller 130 to assume the position shown in FIG. 8*b* in which the line is locked, and slightly squeezed, in the nip 132 between the rollers 110 and 130, the third locking roller 143 (which could also be simply flat or the like as long as it can selectively abut the first locking roller 110) also occasioning the roller 110 to press further onto the line 102 to lock the same to prevent additional unwinding, as in the configuration shown in FIG. 4 of the first embodiment 1. The handle 123 is merely rotated anti-clockwise to release the lock and to restore the dispenser 101 to the dispensing mode. As with other embodiments the roller 110 floats, but the dispenser is held to the underlying dispensing surface 160 by means of the roller 156 of the spring mount 150 (partially shown for clarity purpose) engaging the first locking roller 110 and therebeneath.

Figure 9:
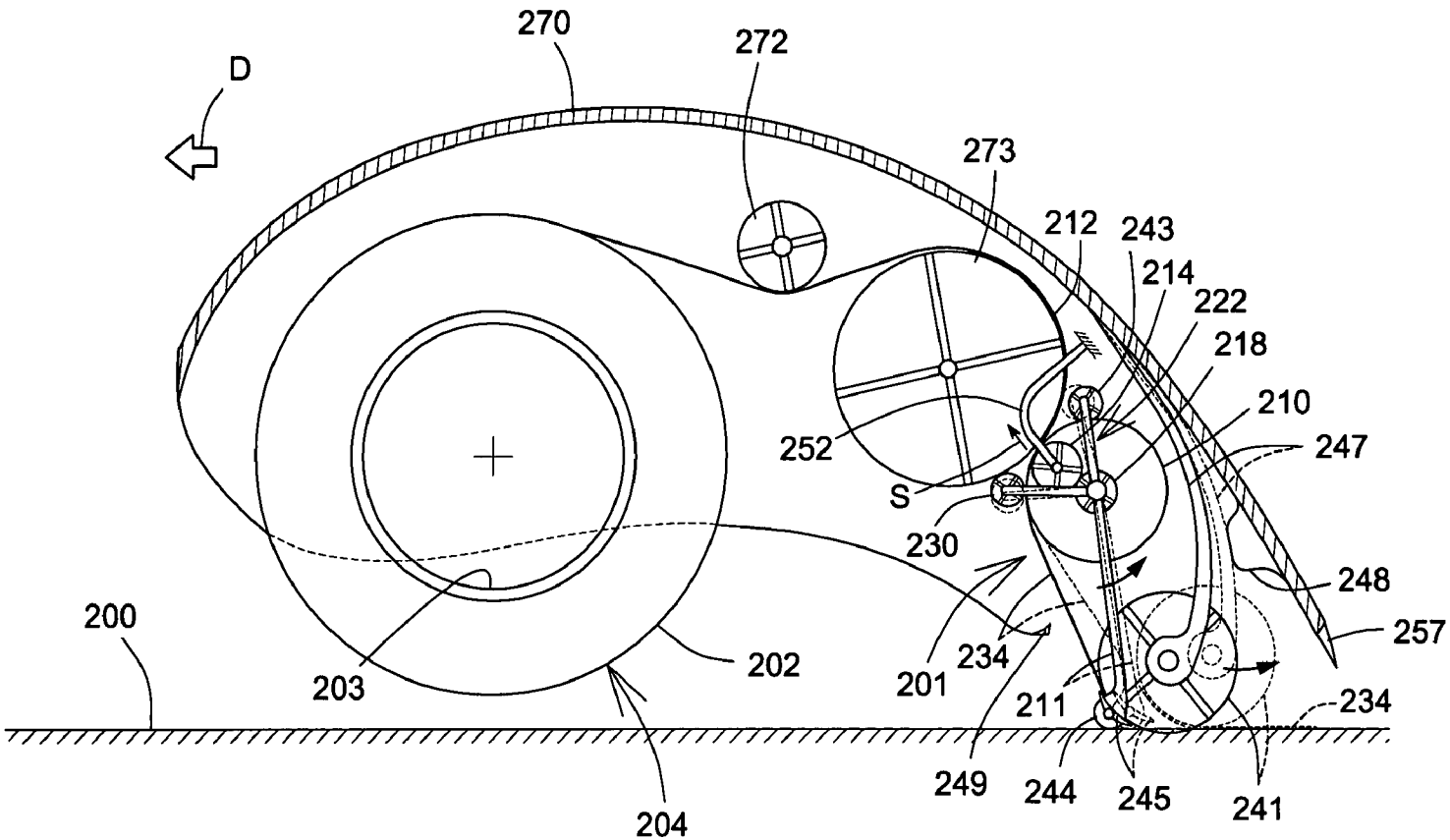
FIG. 9 is a side elevation sectional view of a sixth embodiment of a dispenser for dispensing length material stored on a roll directly onto a surface.

FIG. 9 illustrates another embodiment of packaging-type dispenser 201 to apply a tape 202 on a surface 200 comprising a cover 270 (to be preferably hand-carried or the like) provided with a mounting point in the form of a hub 203 for roll 204 of tape 202, which in the position as shown is reeved around an idler roller 272 and a guide drum 273 and thence to the dispenser 201 between the first locking roller 210 and the second locking roller 230, the third roller 243 selectively pressing down on unwound tape on the drum 273, which constitutes the underlying dispensing surface 212. A lever arm 242 extends from the frame 222 as the sub-frame carrying the third locking roller 243 and the pivot of the mounting roller 218 and at its end distal therefrom there is provided a further roller guide 244 of small diameter, with corresponding extension platform 245. The contact roller 214 is carried on a spring member 252 fixed to the inside of the cover 270 to bias the contact roller 214 towards the underlying dispensing surface 212. An application guide roller 241 preferably abutting on the roller guide 244 is rotatably mounted on a sprung arm 247 fixed to the inside of the cover 270 to bias the lever arm 242 away from the cover 270 to keep the dispenser 201 in the locked position with the third locking roller 243 in contact with the first locking roller 210. In the drawing the dotted outline of the elements identified show them in their positions when the tape is unlocked and can be drawn freely off the roll 204.

In the unused mode of the dispenser 201, the latter is locked by the action of the sprung arm 247 pushing clockwise on the lever arm 242 (via the application guide roller 241 abutting on the roller guide 244), thereby moving the dispenser 201 into a clockwise direction with the tape being locked between the first and second locking rollers 210, 230, with the third locking roller 243 assisting in this action. In case of excessive or inadvertent pushing of the dispenser 201 in a clockwise direction, a lower stopper 249 may be provided onto the frame 270 for the lever arm 242 to abut there against.

To apply tape 202 on the surface 200, the application guide roller 241 is brought into contact with the surface 200 while the dispenser 201 is being displaced in the direction of arrow D with the free end 234 of the tape 202 being applied onto the surface 200 by the roller 241. With the pressure applied onto the guide roller 241, the sprung arm 247 is moved back into abutment contact with an upper stop 248 of cover 270 to release the lever arm 242 and allow the dispenser 201 to move in a counter-clockwise direction from the locked configuration (shown in solid lines in FIG. 9) into the dispensing release configuration (shown in dotted lines in FIG. 9) under the action of the spring member 252. In the dispensing release configuration, the application guide roller 241 is spaced from the roller guide 244 to allow the free end 234 to freely pass there between. A cutting edge 257 is provided on the cover 270 adjacent the application guide roller 241 and once the required length of tape 202 is cut and the cover is moved away from the surface 200 the spring member 252 serves to restore the dispenser to the position shown in solid outline, once again allowing locking of the free end 234 the tape 202. The guide drum 273 may be removed temporarily for the purpose of allowing the passing of the free end 234 between the first and second locking rollers 210, 230 upon replacement of the roll 204.

The present invention thus proposes a practical and yet simple dispenser for length material in varied formats, including but not limited to inter alia adhesive tape, fabric ribbon, metal banding, fibre or metallic rope, all being suitably stored usually on a roll, reel, drum or spool, or freely coiled or merely loose.

Depending on the type of length material to be dispensed as well as on the dispenser configuration, the material covering the surface of the different rollers or platform may vary and have different level of friction with the tape 2 or even between rollers.

When the length material is fragile such as Teflon™ tape or the like, the dispenser could be provided with a assisting electrical motor or the like selectively activatable by the user to help unwinding of the material without excessive pulling force being applied on the free end of the length material.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A dispenser for a length material comprising:

a rotatable first locking member defining a first axis and being radially biased by a biasing member;

a second locking member defining a second axis substantially parallel to said first axis and spaced therefrom;

a nip defined between the first and second locking members for receiving therethough in use at least an end portion of the length material; and a movable frame circumjacent the first locking member for selective contact therewith, the frame carrying said second locking member and being adapted to use to effect relative movement between a locked configuration in which in use the length material is clamped in the nip by the biased first locking member acting against the second locking member and an unlocked configuration in which the length material is free to move through the nip.

2. A dispenser according to claim 1, wherein the first and second locking members are bars coated with a low friction material which in use in the unlocked configuration allows free travel of the at least an end portion of the length material and the locked configuration allows the length material to be clamped in the nip.

3. A dispenser according to claim 1, wherein the first and second locking members are freely rotatable rollers about the first and second axes, respectively.

4. A dispenser according to claim 3, wherein the first and second locking rollers are surface contoured to provide a ribbed surface for contacting the length material.

5. A dispenser according to claim 3, wherein the first locking roller is of hollow cylindrical form and has a greater diameter than that of the second locking roller.

6. A dispenser according to claim 5, wherein the biasing member for the first locking roller is accommodated within the frame.

7. A dispenser according to claim 6, wherein a cross bar is provided and extends within the frame and into the hollow first locking roller, a contact roller is rotatably mounted on the cross bar, the biasing member including the contact roller, and the contact roller is biased thereby into rolling contact with an internal cylindrical surface of the first locking roller.

8. A dispenser according to claim 7, wherein the biasing member is a spring-loaded mount provided for holding the dispenser onto a tubed roll of stored length material, the mount having at least one side piece for being located adjacent a free end of the tubed roll and a central member for engaging the inner surface of the tubed roll.

9. A dispenser according to claim 7, wherein a second, mounting, roller is provided internally of the hollow first locking roller and is mounted on an axle forming part of the frame, axes of the contact roller and the mounting roller being substantially parallel to the first axis and the contact and mounting rollers being in contact with one another.

10. A dispenser according to claim 9, wherein the frame includes a third locking member being an abutment adapted upon appropriate movement of the frame towards the locked configuration to push the first locking member further into a clamping action, associated with the locked configuration, of the at least an end portion of the length material between the first and second locking members, with the biasing member assisting in the clamping action.

11. A dispenser according to claim 8, wherein the spring-loaded mount has an arm carrying the cross bar on which the contact roller is mounted.

12. A dispenser according to claim 8, further comprising a cutting member carried by the spring-loaded mount.

13. A dispenser according to claim 1, further comprising a belt member traveling around corresponding mounting shafts to support the at least an end of the length material.

14. A dispenser according to claim 1, further comprising a freely rotating roller adjacent to the first locking member to support the at least an end of the length material.

15. A dispenser according to claim 1, wherein a guide is provided for supporting the at least an end portion of the length material during unreeling of a piece of the length material.

16. A dispenser according to claim 15, wherein the guide is located on the frame spaced from the first and second locking members in such manner as in use to keep the at least an end portion of the length material spaced away from the first and second locking members in both the locked and unlocked configurations.

17. A dispenser according to claim 1, further comprising a casing and a cutting member on the casing.

18. A dispenser according to claim 17, wherein the casing is shaped to accommodate a roll of the length material, and the casing is provided internally thereof with spring-loaded guides to pressure the length material into contact with the dispenser as the length of material is unwound from the roll.

19. A dispenser according to claim 18, wherein the casing is provided with a movable closure selectively closing an opening mouth thereof to allow the at least an end portion of the length material to extend there through, the closure connecting to the dispenser to selectively unlock the dispenser, upon opening thereof, from the locked configuration to the unlocked configuration.

20. A dispenser according to claim 17, wherein a resiliently loaded roller is provided in the casing and is biased to effect the locking of the dispenser following release of pressure on the resiliently loaded roller.

21. A dispenser system comprising:

a roll of length material having at least an end portion and a dispenser mounted on a portion of the roll of length material, the dispenser comprising:

a rotatable first locking member defining a first axis and being radially biased towards the portion of the roll of length material by a biasing member;

a second locking member defining a second axis substantially parallel to said first axis and spaced therefrom;

a nip defined between the first and second locking members for receiving therethough in use at least an end portion of the length material; and a movable frame circumjacent the first locking member for selective contact therewith, the frame carrying said second locking member and being adapted to use to effect relative movement between a locked configuration in which in use the length material is clamped in the nip by the biased first locking member acting against the second locking member and an unlocked configuration in which the length material is free to move through the nip.

22. A dispenser system according to claim 21, wherein the portion of the roll of length material is intermediate a center of the roll and the first locking member.

23. A dispenser system according to claim 21, wherein the portion of the roll of length material is convex.

* * * * *